United States Patent [19]

Howland

[11] Patent Number: 4,624,295

[45] Date of Patent: Nov. 25, 1986

[54] METHOD OF MANUFACTURING A FINGER-JOINTED WOOD PANEL

[75] Inventor: William A. Howland, Portland, Oreg.

[73] Assignee: The Nicolai Company, Portland, Oreg.

[21] Appl. No.: 735,685

[22] Filed: May 20, 1985

[51] Int. Cl.[4] ..... B27F 1/00

[52] U.S. Cl. ..... 144/347; 52/811; 144/350

[58] Field of Search ..... 144/347, 350, 346; 52/811; 428/106

[56] References Cited

U.S. PATENT DOCUMENTS 161,746 4/1875 Brock .
484,063 10/1892 Studte ..... 144/347
1,720,841 7/1929 Jones .
1,924,240 8/1933 Harwell .

FOREIGN PATENT DOCUMENTS 2822659 11/1979 Fed. Rep. of Germany ..... 144/347

*Primary Examiner*—W. D. Bray
*Attorney, Agent, or Firm*—Klarquist, Sparkman, Campbell, Leigh & Whinston

[57] ABSTRACT

A compound lumber slab is formed from several pieces of lumber which are edge-glued together using finger joints. The fingers have the shape in cross section of truncated triangles. These fingers, and their mating grooves, are alternately disposed along the edges of the lumber so that a saw cutting a panel from the slab will cut through the flat top of a truncated triangle, thereby producing glue lines parallel to the panel edges on the resulting panel surfaces. The truncated triangles are shaped and dimensioned to optimize the structural integrity of the resulting panels. The mating fingers and grooves may have a noninterfering fit to produce closed glue lines on the finished panel surfaces.

8 Claims, 9 Drawing Figures

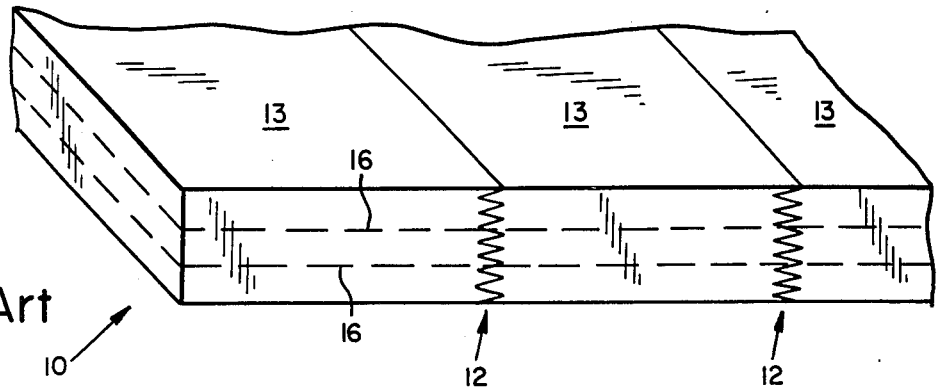
FIG. 1
Prior Art
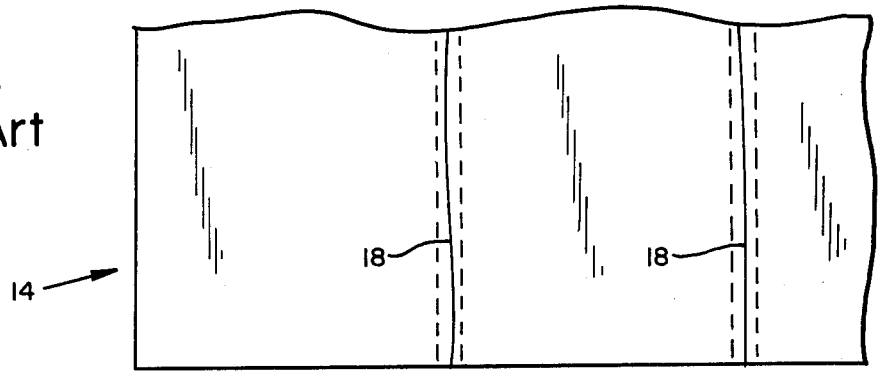
FIG. 2
Prior Art
FIG. 3
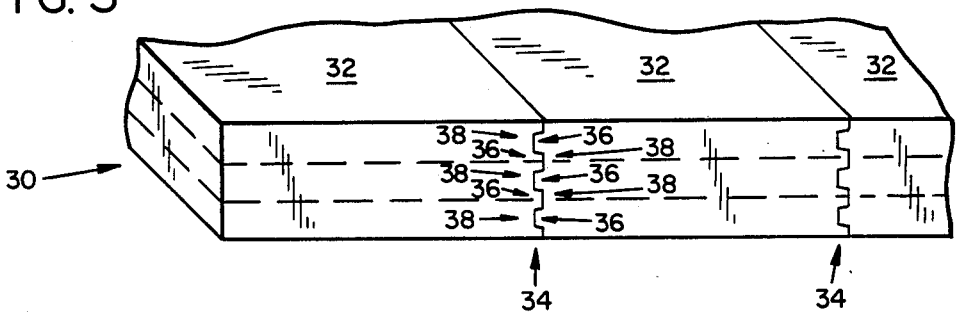
FIG. 4
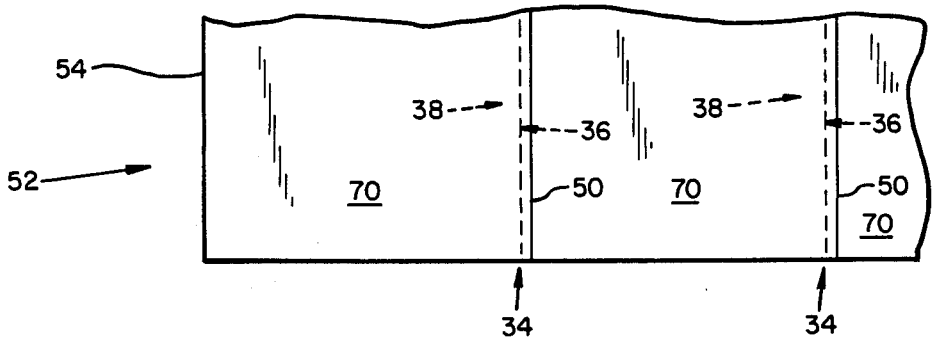

METHOD OF MANUFACTURING A FINGER-JOINTED WOOD PANEL

TECHNICAL FIELD

The present invention relates generally to compound wood slabs and in particular to edge-glued wood slabs that can be resawn into structurally-strong wood panels.

BACKGROUND OF THE INVENTION

Compound lumber slabs, made from lengths of lumber edge-glued together, are used in the wood products industry both as an end product and as an intermediate step in the production of wood paneling. Wood paneling is produced from such slabs by resawing the slab along planes parallel to its face to yield two or more thinner panels. Although the basic concepts of compound lumber and resawn panels are over a half-century old, recent advances in wood-bonding technology have made possible compound wood products that rival one-piece wood products in structural integrity.

The basic concept of compound lumber is disclosed in U.S. Pat. No. 1,924,240 to Harwell. A plurality of short lengths of lumber are glued edge-to-edge and end-to-end to form a single slab. The slab can then be cut along the plane of the slab to form two panels. Harwell's edge joints are formed by a finger on the edge of one lumber piece that mates with a groove in the edge of the adjoining lumber piece to form the slab. When the slab is resawn into two panels, the edge joint becomes a simple lap joint, which is notoriously weak.

Other types of joints are also used in the wood products industry. U.S. Pat. No. 161,746 to Brock, for example, discloses a method of joining two layers of wood using interengaging ribs and grooves on the two adjoining surfaces. The ribs of Brock are truncated triangles having one side normal to the plane of the wood and one side inclined. The width of the ribs is slightly larger than the width of the grooves, so that external pressure is required to force the two boards together. If the forcing is not complete, there will be a visible gap between the two joined pieces where their surfaces meet. The high strength of the joint is primarily attributed to the intimate frictional contact between the layers of wood rather than to the glue.

Other methods for forming wood panels from component wood pieces are also known in the lumber art. U.S. Pat. No. 1,720,841 to Jones discloses a method for producing a board of any width by joining together a plurality of thin lumber pieces by using lap joints. The rabbeted thin stock lumber is produced by notching the edges of thick stock lumber and cutting the thick stock lumber along planes that bisect the notches before lap-bonding the pieces together.

The zigzag or "sawtooth" joint and common butt joint are presently the techniques most used for edge joining a plurality of lumber pieces into a compound slab for resawing into door panels. A sawtooth joint is typically stronger than a butt joint. For a sawtooth joint, a complementary zigzag pattern is cut into the edges of adjoining lumber pieces, which are then mated and glued together. Slight imperfections in the alignment of the zigzags, or deviations in the path of a saw blade from a straight line through the slab, however, can produce pronounced nonparallel glue lines on the faces of the resawn panels cut from such slabs, detracting from the appearance of such panels. In addition, zigzag joints must be pressed together and bonded under high pressure because of the interference fit commonly provided between the fingers and grooves. If pressure is insufficient, gaps may appear along the joint line on the surfaces of resulting panels.

Although most of the foregoing methods for forming compound lumber panels can be used to produce resawn panels of any desired width, the structural integrity of the resulting panels is sometimes inadequate. Wood panels used in exterior doors, for example, must afford some measure of security. The weakness of prior butt and lap joints makes them unsuitable in such applications.

Compound wood panels used in finished wood product, such as doors, must also have a pleasing appearance. As noted, the zigzag and other prior finger-type joints can produce resawn panels with noticeably nonparallel glue lines or gaps in such lines. Such panels are unsuitable for applications, such as for door panels, where appearance is important.

Accordingly, a need remains for a compound wood slab that, when resawn, yields panels with a high degree of structural integrity as well as a pleasing appearance.

SUMMARY OF THE INVENTION

It is an object of the present invention to provide a finger joint having higher strength than prior art finger joints.

It is a further object of the present invention to provide a compound lumber slab that, when resawn into panels, produces glue lines that extend parallel to the edges of the panels.

It is yet another object of the present invention to provide a compound lumber slab which may be sawn in half or in thirds and produce glue lines on the face of the resulting resawn panels which extend parallel to the edges of the panels.

In the preferred embodiment of the present invention, pieces of lumber are edge-glued together using finger joints to form a compound slab. The fingers have the shape in cross section of truncated triangles. These fingers, and their mating grooves, are alternately disposed along the edges of the lumber so that a saw cutting a panel from the slab will cut through the flat top of a truncated triangle, thereby producing glue lines parallel to the panel edges on the resulting panel surfaces. The truncated triangles are shaped and dimensioned to optimize the structural integrity of the resulting panels. The mating fingers and grooves may have a noninterfering fit to produce closed glue lines on the finished panel surfaces.

The foregoing and additional objects, features and advantages of the present invention will be more readily apparent from the following detailed description of a preferred embodiment thereof which proceeds with reference to the accompanying drawings.

BRIEF DESCRIPTION OF THE DRAWINGS

FIG. 1 is a perspective view of a compound wood slab of the prior art manufactured using zigzag joints;

FIG. 2 is a top view of a typical resawn panel produced from the compound slab of FIG. 1;

FIG. 3 is a perspective view of a compound slab manufactured in accordance with the present invention;

FIG. 4 is a top view of a resawn panel produced from the slab of FIG. 3;

DETAILED DESCRIPTION OF PREFERRED EMBODIMENT

Prior Art

Figure 6:
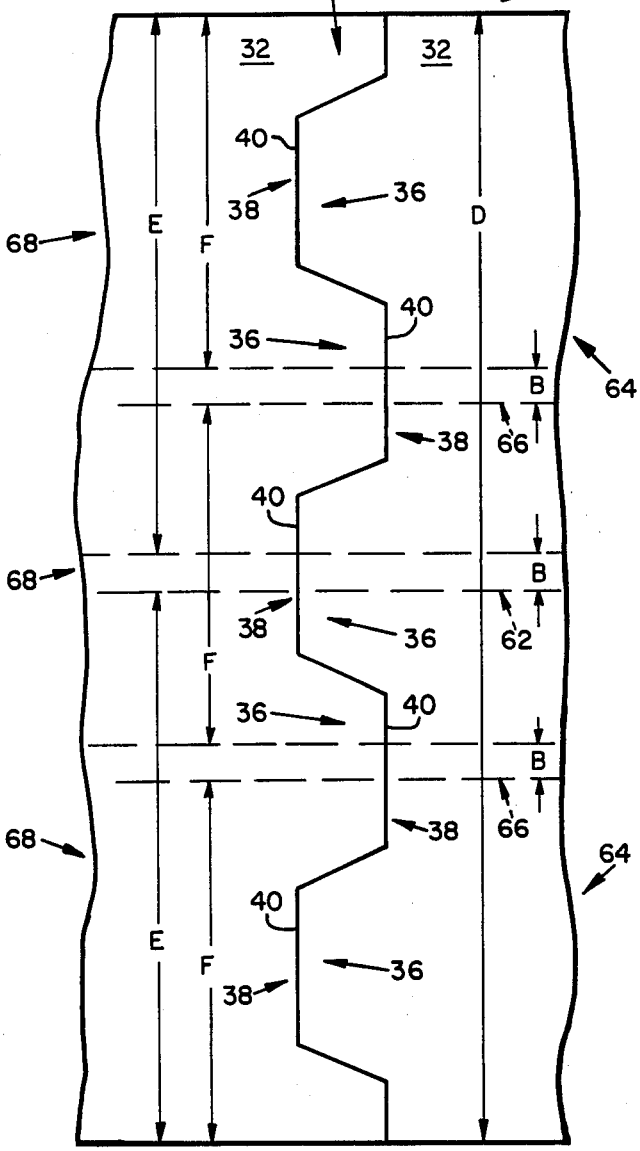
FIG. 6 is an enlarged end view of a joint portion of another compound slab manufactured in accordance with the present invention.

With reference to FIGS. 1 and 2, compound lumber slabs 10 known in the prior art typically employ glued zigzag finger joints 12 to connect adjoining pieces of lumber 13. When such compound slabs are resawn into thinner panels 14, such as along dashed lines 16 shown in FIG. 1, the glue lines 18 produced on the face of the panels are often noticeably not parallel, due to slight misalignments of the narrow interengaging zigzag edges, or slight deviations of the saw blade from a straight path in resawing the slabs. The nonparallel lines apparent on such resawn panels make them unsuitable for certain applications where a finished appearance is important, such as for door panels.

Compound Slab

As shown in FIG. 3, the compound lumber slab 30 of the present invention comprises multiple lengths of lumber 32 edge-glued together along finger joints 34 having multiple fingers 36 and grooves 38. Fingers 36 at one edge of one length are substantially complemental in shape to mating grooves 38 of the mating edge of an adjacent length. Fingers 36 and grooves 38 in cross section have truncated triangular shapes with sloping opposite sides 46. All fingers preferably are of the same size and shape, as are all grooves.

Figure 5:
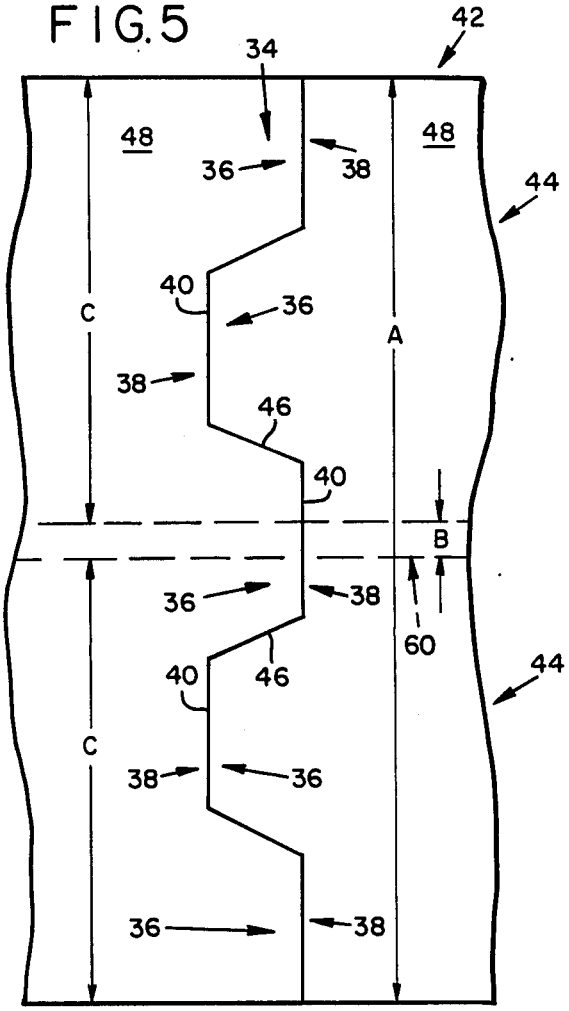
FIG. 5 is an enlarged end view of a joint portion of a compound slab in accordance with the present invention.

With reference to FIG. 5, the flats 40 of fingers 36 and grooves 38 are dimensioned for a given thickness of lumber 'A' and width of a saw kerf 'B' such that slab 42 can be resawn edgewise into pieces 44 of equal thickness C. The kerf 60 of such a cut passes through flat 40 of a finger 36 and a corresponding groove 38 between its opposite side edges 46. Opposite sides 46 are preferably inclined about 22 degrees relative to a line perpendicular to flats 40. Fingers 36 and grooves 38 should be formed in sufficient number such that the resulting edge-sawn panels 44 will be made up of lumber lengths 48 glued together at edge joints 34 comprising at least one complemental finger 36 and groove 38. As shown in FIG. 4, the glue lines 50 on the resulting panel face 52 will thus extend lengthwise of panel 52 substantially parallel to the panel's side edges 54. The large surface area of the glue line strengthens the compound slab.

Slab 42 shown in FIG. 5 has, for example, a nominal thickness A of approximately one and one-half inches. The kerf 60 of the bandsaw used to resaw the slab is typically about 0.1 inches. Finger joints 34 are dimensioned such that one edge of one length 48 includes at least two complete fingers 36 and one complete groove 38. The mating edge of the adjacent length includes at least one complete finger 36 and two complete grooves 38.

Finger joints 34 are dimensioned, as described above, so that a saw cutting slab 42 along dashed lines 60 will yield two panels 44 having a thickness C of approximately 0.7 inches, each of which has a complete finger 36 and groove 38 joint. Since flat 40 runs through the length of slab 42 parallel through to its edges, a saw cut through this flat will produce panels 44 having glue lines that extend parallel to the panels' edges.

In an alternative arrangement, shown in FIG. 6, the compound slab 30 has, for example, a nominal width D of two inches. Finger joints 34 are dimensioned such that one edge of one length 32 includes at least three complete fingers and two complete grooves. The mating edge of an adjacent length includes at least two complete fingers and three complete grooves.

Finger joints 34 are dimensioned in FIG. 6 so that slab 30 can be cut in either halves or thirds to yield panels of equal thicknesses with parallel glue lines and with at least one complementary finger 36 and groove 38 pair. If cut in half, along dashed lines 62, slab 30 would yield two panels 64 having a nominal thickness E of approximately 0.95 inches. If cut in thirds, along dashed lines 66, slab 30 would yield three panels 68, each having a nominal thickness F of approximately 0.6 inches. Either cutting pattern would route the saw kerf through the center of a flat 40, thereby producing parallel glue lines on the resulting panels.

Resawn Panel

Figure 7:
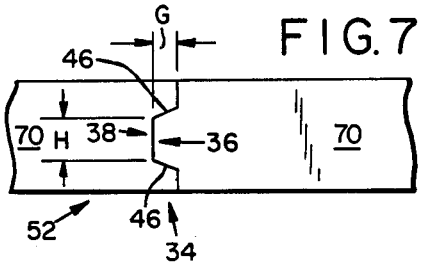
FIG. 7 is an edge view of a joint portion of a resawn wood panel cut from the slab of FIG. 5 according to the present invention.

The resawn wood panel 52 of the present invention, shown in FIGS. 4 and 7, comprises multiple lengths of lumber 70 edge-glued together along finger joints 34. Each finger joint 34 includes at least one complete finger 36 and a corresponding complemental groove 38. Each complete finger 36 and groove 38 in cross section has the shape of a truncated triangle with sloping opposite sides 46. This panel is resawn from a slab 30, such as that shown in FIG. 3, having a thickness which is nominally a multiple of a thickness of the panel. In such a resawn panel, and therefore in the slab from which the panel is sawn, the depth G of each groove 38 is preferably less than the width H across the bottom of each groove 38 and finger 36 for optimum strength of the joint.

Figure 9:
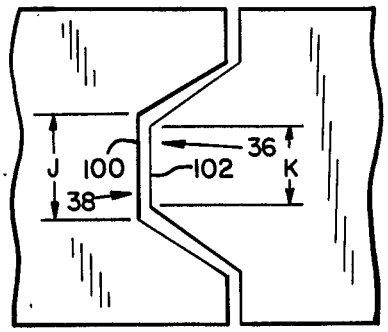
FIG. 9 is an exaggerated detail of a finger joint portion of the panel of FIG. 7.

FIG. 9 is an exaggerated view of the finger joint of FIG. 7 to show that the width J across the bottom of each groove 38 is preferably slightly greater than the width K across the top of each finger 36, such that each finger 36 and mating groove 38 have a slight noninterfering, or clearance, fit. Thus, the strength of the joint does not rely on the friction of an interfering fit as is the case with most prior finger joints. Instead, such joint relies on the shape of the fingers and grooves, the strength of the glue which bonds them, and the large bonding surface area provided by the fingers and grooves, for its strength.

Method of Manufacturing Panels

The method of the present invention produces multiple wood panels of equal thickness from a slab of greater thickness. The slab is made up of multiple lengths of lumber edge-glued together along the previously-described finger joints.

Figure 8:
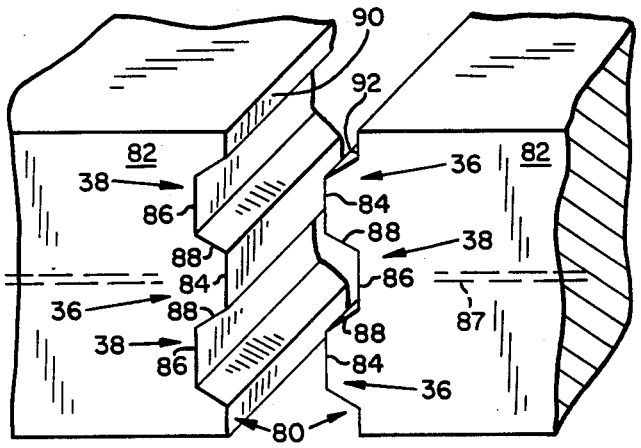
FIG. 8 is a perspective view of two lumber pieces cut according to the present invention before being glued together.

As shown in FIG. 8, alternating fingers 36 and grooves 38 of the described configuration are first cut lengthwide into the side edges 80 of the lumber lengths 82 to be joined using cutting tools well known in the industry. In so cutting, fingers 36 of one edge of one length 82 are formed substantially complemental in shape to grooves 38 of the adjacent edge of an adjacent length 82. Fingers 36 and grooves 38 are formed to have in cross section the previously-described truncated triangular shape, with the flats 84 of the fingers 36 and the flats 86 of the grooves 38 being greater in width than the thickness of kerf 87 produced by the resawing operation. Flats 84 and 86 of these triangular shapes are dimensioned and positioned across the thickness dimension of lumber 82 such that kerf 87 will pass through a flat between its opposite side edges 88 when the slab is resawn into panels of equal thickness. Fingers 36 and grooves 38 are formed in sufficient numbers such that the resulting panels will be made up of lumber lengths 82 joined together at edge joints comprising at least one complete complemental finger and groove pair.

The fingers 36 of one set of edges 90 of the lengths 82 are inserted and edge-glued into the complemental-aligned grooves 38 of an adjacent set of edges 92 to form the composite slab. The slab is then resawn along dotted lines 87 into multiple panels of equal thickness. The resulting panels comprise multiple lengths of lumber edge-glued together at complete finger joints. Each joint produces a joint line on the panel face which extends lengthwise of the panel substantially parallel to the panel's side edges, that is, at least not visibly nonparallel.

As shown in FIG. 9, the flats 100 of grooves 38 are preferably formed to have a width 'J' slightly greater than the width 'K' of the flats 102 of fingers 36, so as to provide a noninterfering fit, whereby the lumber lengths can be joined without the application of pressure. The width 'J' of grooves 38 can be, for example, 0.004 inches greater than the width 'K' of fingers 36.

In the preferred embodiment, flats 102 of fingers 36 and flats 100 of grooves 38 are formed to be wider than the grooves are deep for optimum strength of the fingers. Flats 102 of fingers 36 and flats 100 of grooves 38 can be formed to have widths substantially greater than, for example, at least twice as great as, the thickness of the saw kerf to ensure that the path of a saw blade will not intersect a sloping sidewall of a finger during the resawing operation.

The method of manufacturing panels can include forming fingers 36 and grooves 38 such that all fingers are of the same size and shape and all grooves are of the same size and shape.

Having illustrated and described the principles of my invention with reference to a preferred embodiment, it should be apparent to those skilled in the art that the invention may be modified in arrangement and detail without departing from such principles. I claim as my invention such embodiment and all modifications coming within the spirit and scope of the following claims.

I claim:

1. A method of manufacturing multiple wood panels of equal thickness from a slab of greater thickness made up of multiple lengths of lumber edge-glued together along finger joints, said method comprising:

cutting lengthwise alternating fingers and grooves into the side edges of the lengths of lumber to be joined and in so cutting:

forming the fingers of one edge of one length substantially complemental in shape to the grooves of the adjacent edge of an adjacent length, the fingers and grooves each having flats greater in width than the thickness of kerf produced by a resawing operation;

dimensioning and positioning such flats across the thickness dimension of the lumber such that the kerf will pass through a flat between its opposite side edges when the slab is resawn into the panels of equal thickness; and forming the fingers and grooves in sufficient number such that the resulting panels will be made up of lumber lengths joined together at edge joints comprising at least one complete complemental finger and groove;

then inserting and edge-gluing the fingers of one set of edges of the lengths into the complemental aligned grooves of an adjacent set of edges of the lengths to form said slab; and then resawing said slab into said multiple panels of equal thickness, whereby the resulting panels comprise multiple lengths of lumber edge-glued together at complete finger joints, with such joints having joint lines on the panel faces extending lengthwise of the panels substantially parallel to the panel side edges.

2. A method of manufacturing multiple wood panels of equal thickness from a slab of greater thickness made up of multiple lengths of lumber edge-glued together along finger joints, said method comprising:

cutting lengthwise alternating fingers and grooves in the side edges of the lengths of lumber to be joined and in so cutting:

forming the fingers of one edge of one length substantially complemental in shape to the grooves of the adjacent edge of an adjacent length, forming the fingers and grooves to have in cross section a truncated triangular shape with the flats of the fingers and grooves being greater in width than the thickness of kerf produced by a resawing operation;

dimensioning and positioning such flats across the thickness dimension of the lumber such that the kerf will pass through a flat between its opposite side edges when the slab is resawn into the panels of equal thickness; and forming the fingers and grooves in sufficient numbers such that the resulting panels will be made up of lumber lengths joined together at edge joints comprising at least one complete complemental finger and groove;

then inserting and edge-gluing the fingers of one set of edges of the lengths into the complemental aligned grooves of an adjacent set of edges of the lengths to form said slab; and then resawing said slab into said multiple panels of equal thickness, whereby the resulting panels comprise multiple lengths of lumber edge-glued together at complete finger joints, with such joints having joint lines on the panel faces extending lengthwise of the panels substantially parallel to the panel side edges.

3. A method according to claim 2 including forming the flats of the grooves to a width slightly greater than the flats of the fingers to provide a non-interfering fit.

4. A method according to claim 2 including forming the flats of the fingers and the flats of the grooves to widths greater than the depths of the grooves.

5. A method according to claim 2 including forming the flats of the fingers and the flats of the grooves to widths at least about twice the thickness of the saw kerf.

6. A method according to claim 2 including forming the slab of lengths of lumber having a nominal thickness of two inches and dimensioning the finger joints such that one edge of one length includes at least three complete fingers and two complete grooves and the mating edge of an adjacent length includes at least two complete fingers and three complete grooves.

7. A method according to claim 2 including forming the slab of lengths of lumber having a nominal thickness of one and one-half inches and dimensioning the finger joints such that one edge of one length includes at least two complete fingers and one complete groove and the mating edge of an adjacent length includes at least one complete finger and two complete grooves.

8. A method according to claim 2 including forming the fingers and grooves such that all fingers are of the same size and shape and all grooves are of the same size and shape.

* * * * *